US009660334B2

(12) United States Patent
Corliss et al.

(10) Patent No.: US 9,660,334 B2
(45) Date of Patent: May 23, 2017

(54) COLLAPSIBLE GROUND PLANE FOR SATCOM ANTENNA

(71) Applicant: R.A. Miller Industries, Inc., Grand Haven, MI (US)

(72) Inventors: Abraham G. Corliss, Spring Lake, MI (US); Roger A. Cox, Spring Lake, MI (US); Paul E. Miller, Spring Lake, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 113 days.

(21) Appl. No.: 14/667,080

(22) Filed: Mar. 24, 2015

(65) Prior Publication Data

US 2015/0288060 A1 Oct. 8, 2015

Related U.S. Application Data

(60) Provisional application No. 61/974,224, filed on Apr. 2, 2014.

(51) Int. Cl.

| | |
|---|---|
| ***H01Q 1/12*** | (2006.01) |
| ***H01Q 1/48*** | (2006.01) |
| ***H01Q 1/08*** | (2006.01) |
| ***H01Q 1/32*** | (2006.01) |
| ***H01Q 1/44*** | (2006.01) |
| ***H01Q 9/38*** | (2006.01) |

(52) U.S. Cl.

CPC ..... *H01Q 1/48* (2013.01); *H01Q 1/08* (2013.01); *H01Q 1/1235* (2013.01); *H01Q 1/3275* (2013.01); *H01Q 1/44* (2013.01); *H01Q 9/38* (2013.01)

(58) Field of Classification Search

CPC ..... H01Q 1/12; H01Q 1/1235; H01Q 1/32; H01Q 1/3275; H01Q 1/48

See application file for complete search history.

(56) References Cited

U.S. PATENT DOCUMENTS

| | | | | |
|---|---|---|---|---|
| 1,683,270 A | | 9/1928 | Taylor et al. | |
| 2,572,430 A | | 10/1951 | Balton | |
| 3,217,328 A | | 11/1965 | Miller | |
| 5,614,918 A | * | 3/1997 | Dinardo | F16M 11/02 248/181.1 |
| 6,975,178 B1 | | 12/2005 | Kessler et al. | |
| 8,674,894 B2 | * | 3/2014 | Harak | H01Q 1/04 343/719 |

* cited by examiner

*Primary Examiner* — Hoang Nguyen

(74) *Attorney, Agent, or Firm* — McGarry Bair PC

(57) ABSTRACT

A collapsible ground plane for a mobile UHF satcom antenna mounted on a riser comprises a hub and a plurality of conductive members, some of which extend radially from the hub with additional conductive members that extend peripherally between adjacent distal ends of the radially extending conductive members. Each conductive member is flexible so as to yield upon an impact, and return to its original shape when the impact is relieved.

11 Claims, 7 Drawing Sheets

COLLAPSIBLE GROUND PLANE FOR SATCOM ANTENNA

CROSS-REFERENCE TO RELATED APPLICATION(S)

This application claims the benefit of U.S. Provisional Patent Application No. 61/974,224, filed Apr. 2, 2014, which is incorporated herein by reference in its entirety.

BACKGROUND

When UHF satcom antennas are vehicle mounted, they typically need to be elevated for better reception capability, thus necessitating a riser so that the vehicle itself no longer provides a ground plane for the antenna. Hence, when the antenna is not directly mounted to the vehicle, an alternative ground plane is needed. It is known to provide a metal disc on the riser to serve as a ground plane. But typical disc-style ground planes can be damaged by impacts in the field. Damage to the ground plane negatively affects performance of the UHF satcom antenna.

BRIEF DESCRIPTION

In one aspect, embodiments of the invention relate to a collapsible ground plane for an antenna including a hub for mounting to one of a riser or an antenna, a set of radial conductive members extending radially from a proximal end mounted to the hub to a distal end, and having connectors to electrically connect to an antenna, and a peripheral conductive member connected between at least two distal ends of adjacent radial conductive members. The set of radial conductive members and the peripheral conductive member have a linkage which can yield under a force then return to its original shape when the force is relieved.

In another aspect, embodiments of the invention relate to an antenna assembly including a satcom antenna, a conductive hub mounted to a lower end of the satcom antenna, a set of radial conductive members extending radially from a proximal end mounted to the conductive hub to a distal end, and a peripheral conductive member connected between at least two distal ends of adjacent radial conductive members. The set of radial conductive members and the peripheral conductive member have a linkage which can yield under a force then return to its original shape when the force is relieved.

DETAILED DESCRIPTION

Figure 1:
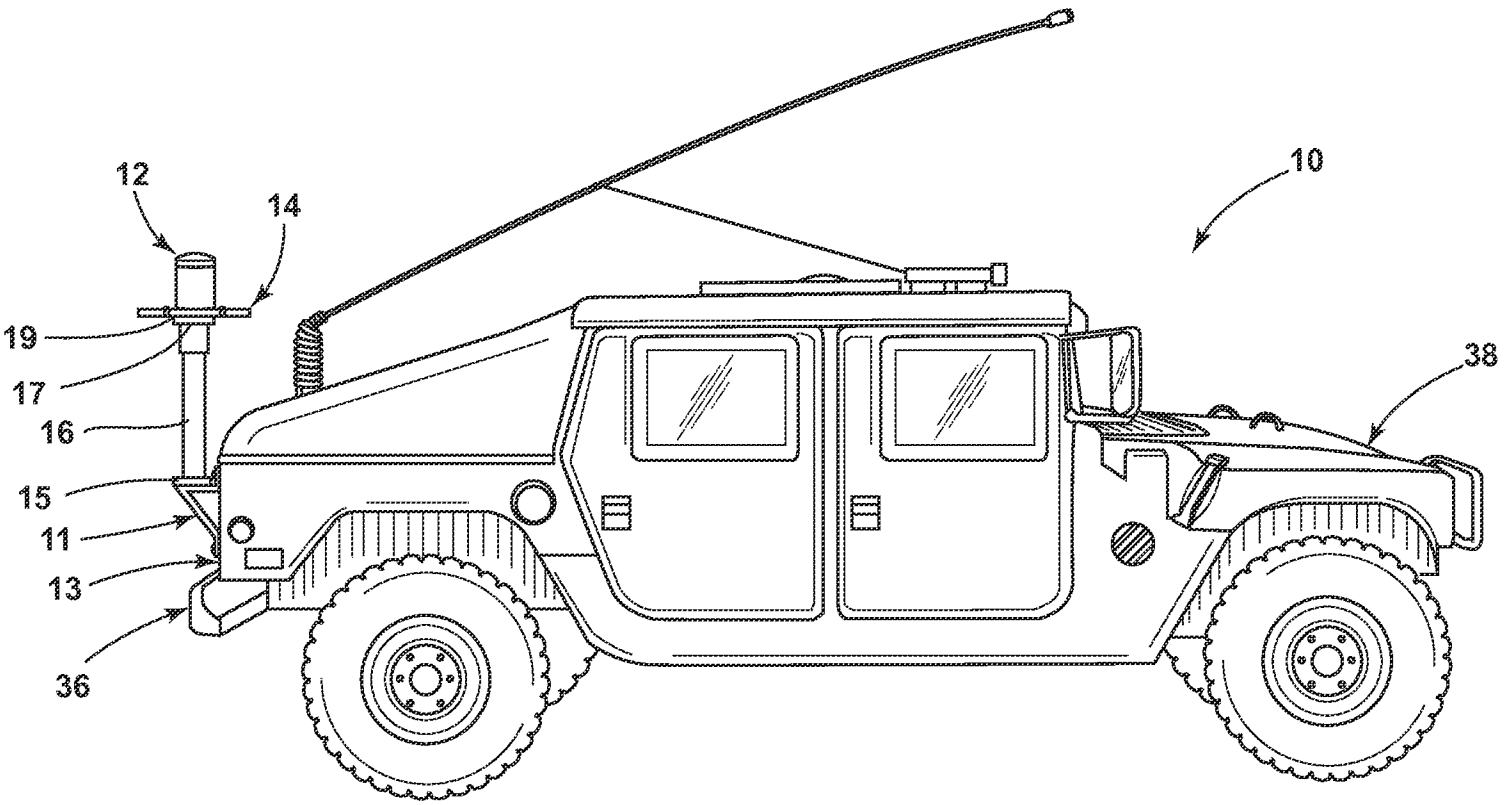
FIG. 1 shows a side view of a vehicle equipped with a riser, ground plane, and antenna for communications according to an embodiment of an invention.

Referring now to FIG. 1, a vehicle 10 has a UHF satcom antenna 12 and a ground plane 14 mounted on a riser 16 extending from a bracket 11 which is located at a rear surface 13 of the vehicle in a typical environment for an embodiment of the invention. The bracket 11 is conductive, typically being formed of sheet metal and mounted to the vehicle 10 in a conventional manner such as in the form of a weld, bolt, rivet, fastener or screw. It may be mounted to or above (as shown) a bumper 36 on the vehicle. The riser 16 is a hollow metal tube that may have a height of 12 to 48 inches. A proximal end 15 of the riser 16 attaches directly to the bracket 11 and a distal end 17 supports the ground plane 14 and the UHF satcom antenna 12. The distal end 17 preferably includes a flat surface 19 to vertically support a ground plane 14 and antenna 12. Preferably, the riser 16 will be sized so that when the antenna 12 is mounted thereto, it will project above any metal surface of the vehicle to minimize interference for optimal performance. The ground plane 14 is disposed between the antenna 12 and the riser 16, and is mounted to the riser 16 in a conventional manner such as in the form of a weld, bolt, rivet, fastener or screw. It will be understood that the UHF satcom antenna 12 is at least one or perhaps more than one that may be mounted to the vehicle 10. Moreover, it will be understood that the location is not limited to the location shown in FIG. 1; at least one UHF satcom antenna 12 may be mounted near or on either side of the engine compartment 38, for example, typically with a riser 16.

The vehicle 10 may include equipment to engage in radio frequency communications. Radio frequency communications may include the transmission or reception of radio broadcasts from a variety of equipment and modalities including hand-held, portable, two-way radio transceivers (i.e. "walkie-talkies"), marine and aviation environments, fixed base stations and satellite communications. The antenna 12 facilitates satellite communications.

Figure 2:
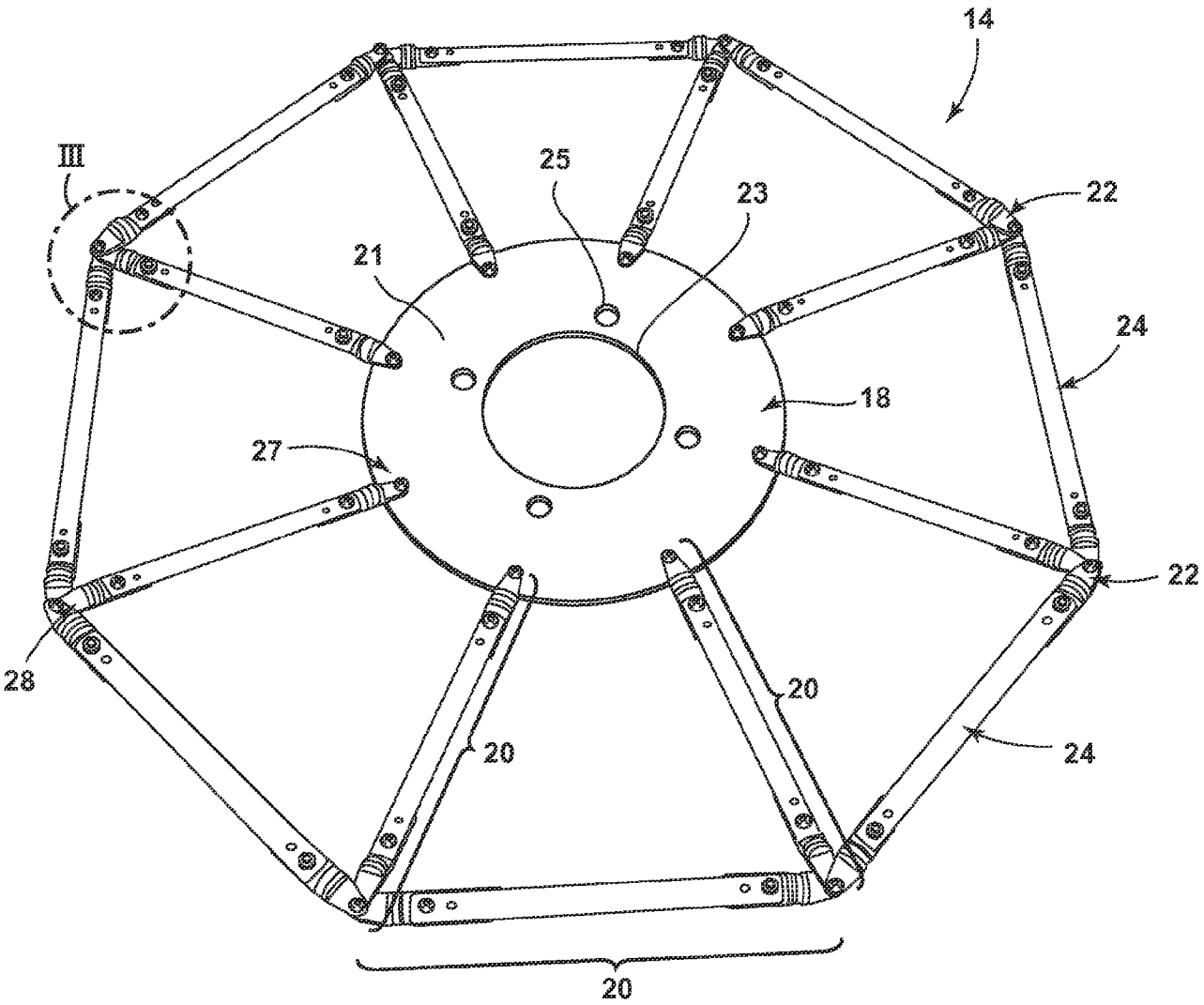
FIG. 2 shows a top view of the ground plane of FIG. 1.

Referring now to FIG. 2, the ground plane 14 comprises a hub 18, which may be a circular conductive plate 21, though other shapes may be used in alternate embodiments. The size and shape of the circular conductive plate 21 will preferably be consistent with the size and shape of a base of the antenna 12. The antenna 12 (including its base) is typically cylindrical in shape, and thus the illustrated embodiment has the same diameter as the antenna 12. The circular conductive plate 21 may include a center hole 23 to facilitate cabling for the antenna 12, such as a coaxial transmission line (not shown). A plurality of attachment holes 25 disposed around the center hole 23 facilitate mounting the hub 18 to the flat surface 19 of the riser 16. Preferably removable fasteners such as a screws or bolts can extend through the attachment holes 25 into the flat surface 19 so that the ground plane 14 can be removably mounted to the riser 12. Typical materials for the circular conductive plate 21 include aluminum or steel though it may be made of any conductive material including non-metals. Aluminum has multiple benefits including ease of purchasing, light-weight, cost effectiveness, and ease of manufacturing.

Sample dimensions for the hub 18 include the diameter of the circular conductive plate 21 being about 7 inches. The center hole 23 in the embodiment may be approximately 3 inches in diameter and the attachment holes 25 in the embodiment may be approximately ⅜ inches in diameter located radially approximately 0.75 inches from the edge of the center hole spaced at equal intervals, in other words the attachment holes 25 are a standard 4.5 inch bolt circle (NATO mount). The thickness of the hub 18 may be approximately 0.2 inches and the diameter of the hub 18 may be approximately one third the diameter of the ground plane 14.

It will be understood that any or all of these dimensions will differ for a given application.

The ground plane further comprises a plurality of conductive members 20, some of which extend radially from the hub 18 and preferably equally spaced from each other. Each of the conductive members 20 comprises an end fitting 22 at each end thereof and a linkage 24 extending between the end fittings 22. The end fitting 22 on a proximal end 27 of each radially extending conductive member 20 attaches to the circular conductive plate 21 in a conventional manner such as in the form of a weld, bolt, rivet, fastener or screw so as to maintain electrical conductivity with the circular conductive plate 21. The present embodiment has at least eight conductive members 20 extending radially from the hub 18. The end fitting 22 on a distal end 28 of each radially extending conductive member 20 attaches to an end fitting 22 on a conductive member 20 that extends peripherally between adjacent distal ends 28 of the radially extending conductive members 20. Preferably, the conductive members 20 may all be the same length, though their lengths may differ in alternate embodiments.

The linkage 24 in each conductive member 20 connects to the end fittings 22 by form of a weld, bolt, rivet, fastener or screw so as to maintain electrical continuity throughout the ground plane 14. Each linkage 24 may comprise at least one curved or flat blade, spring, bendable tube, wire, telescoping arms, rigid-foldable cellular structures, shape memory alloy part or any other structure which can yield under a force then return to its original shape when the force is relieved. For example, each linkage 24 can be flexible so as yield upon an impact, and return to its original shape when the impact is relieved. Typical materials for the end fittings 22 and linkages 24 may be aluminum or steel, though they may be made of any conductive material including non-metals, so long as the material or its structure can yield under force, and return to its original shape when the force is relieved.

Figure 3:
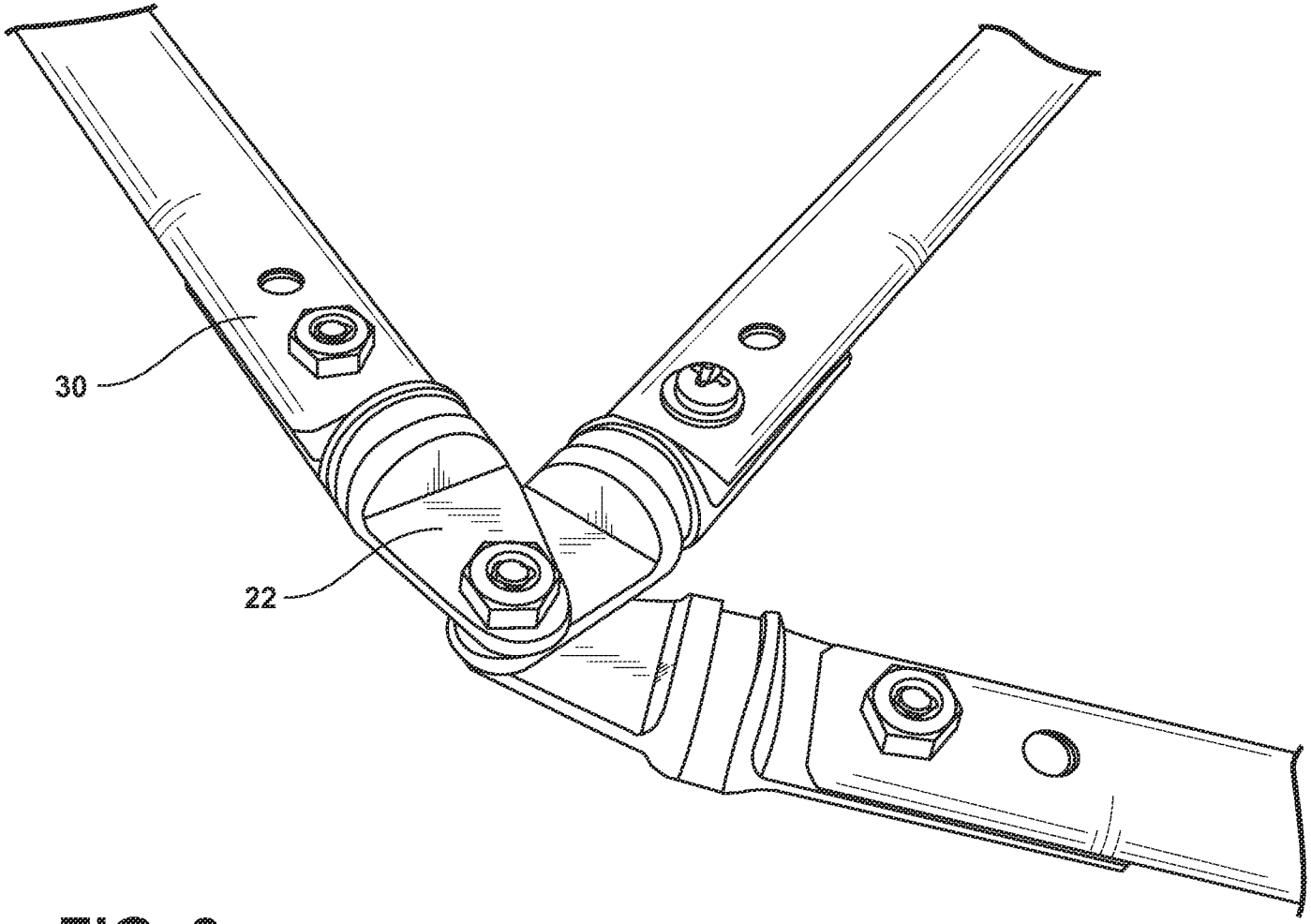
FIG. 3 shows an enlarged view of a periphery joint of the ground plane of FIG. 2.

Referring now to FIG. 3, the end fittings 22 may have a cruciform cross sectional shape. The end fittings 22 stack atop one another at the connection point and attach using a bolt, rivet, fastener or screw. The members must be able to rotate relative to each other. Another embodiment may have the periphery joints made as a hinge, ball bearing joint or any flexible coupling which may eliminate the use of end fittings 22 around the periphery. The members 20 may be made as a single part.

Figure 4:
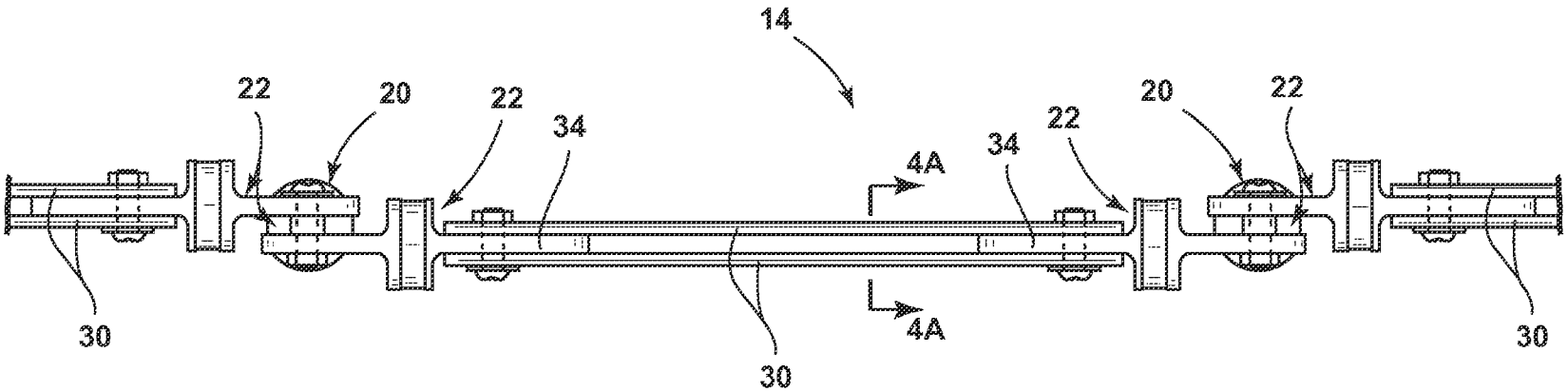
FIG. 4 shows a side view FIG. 2.
Figure 4A:
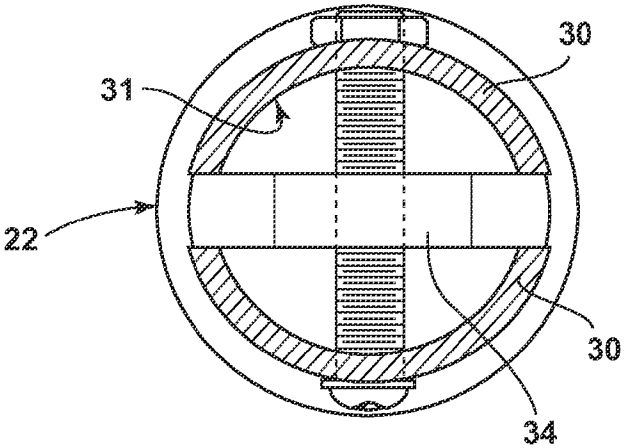
FIG. 4A shows a cross sectional view taken along lines 4A-4A of FIG. 4.

Referring now to FIGS. 4 and 4A, a linkage 24 in the illustrated embodiment comprises two parallel curved blades 30, each attached at an end 34 thereof to an end fitting 22 and spaced from each other with a concave portion 31 in facing relationship. The curvature of each blade 30 enables the linkage 24 to be flexible and provides the structural capability to return each blade 30 to its original shape after twisting or bending. The dual blade design with a gap allows movement of each linkage 24 without permanent damage to the conductive member 20. In the present embodiment each linkage 24 is approximately 0.75 inches wide, 6 inches long and 0.0625 inches thick. It will be understood that the linkages 24 may be a different size, shape and thickness in alternate embodiments. Either or both of the linkages 20, 24 may be oriented 90 degrees from that shown in the Figures. For example, the linkages 24 of the periphery may be oriented 90 degrees relative to the radial members 20.

Figure 5:
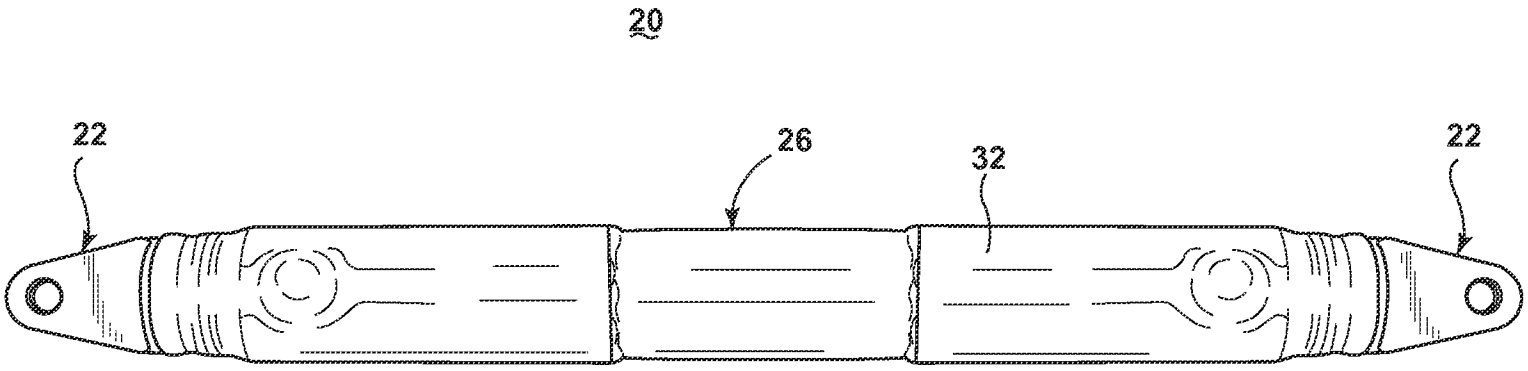
FIG. 5 shows an alternative embodiment of a member of the ground plane with a covering.

Referring now to FIG. 5, an alternate embodiment of the invention shows a member 20 with a covering 26 of heat shrink tubing 32. The heat shrink tubing 32 is preferably an elastomer that provides damage/abrasion resistance and electrical insulation though paint, tape, or any plastic wrapping and the like. Heat shrink tubing 32 may be preferable because it is easily purchased in the desired size, light weight and easy to form into the requisite shape and tightness while maintaining pliability of the assembly.

Figure 6:
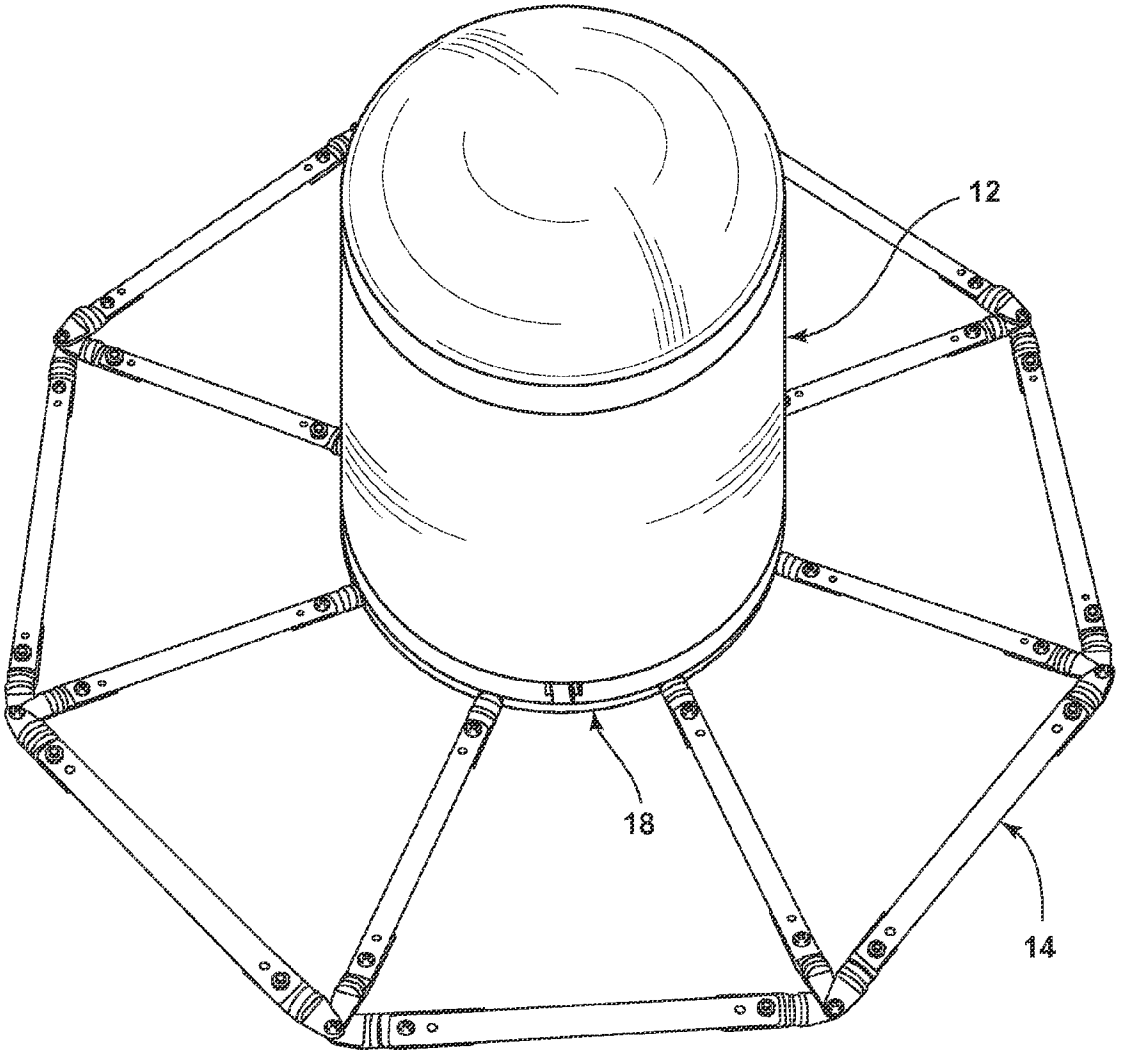
FIG. 6 shows an enlargement of the ground plane and antenna assembly of FIG. 1.

FIG. 6 shows an assembly comprising the antenna 12 and the ground plane 14. The antenna 12 preferably attaches to the hub 18 via a weld, bolts, rivets, fasteners or screws with cabling (not shown) extending through the center hole 23. The attachment methodology may be permanent or removable. The present embodiment shows the hub 18 having a diameter equal to the diameter of the antenna 12. In an alternate embodiment, the hub 18 may be larger in comparison to the antenna 12.

In the embodiment, the outer diameter of the ground plane 14 is twenty inches and the peripheral shape is an octagon. The requisite wave propagation range determines the number of members 20 utilized and the outer diameter of the ground plane 14.

Figure 7:
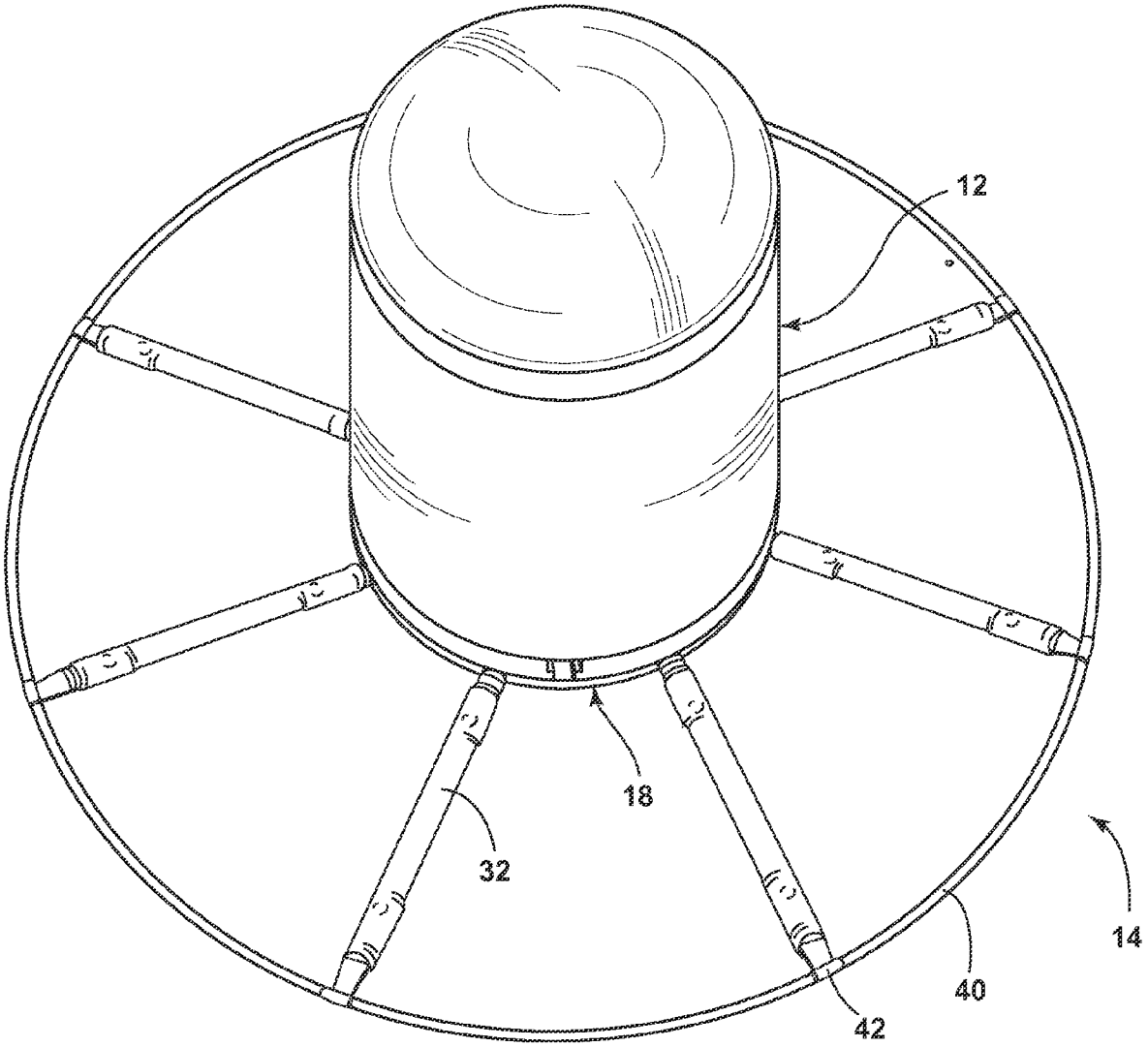
FIG. 7 shows an alternative embodiment of the ground plane with a flexible cable forming the periphery.

Referring now to FIG. 7, an alternate embodiment of the invention shows a flexible cable 40 forming the periphery shape of a circle. The cable 40 may be made of speedometer cabling or any flexible cabling which is conductive but can yield then return to its original shape. This cable 40 is attached to the end fittings 22 with a crimped connection 42. The crimped connection 42 and cable 40 may be made of steel though they also may be made of any conductive material including non-metals. The connection 42 may be made in the form of tape or weld in alternate embodiments. The end fittings 22 of the radial members 20 may provide a loop at the distal end 28 in order to provide placement for the cable 40 without the use of connections 42.

For optimal reception, the antenna 12 is elevated from the vehicle 10 thereby necessitating the use of a riser 16 and ground plane 14. Due to the location of the ground plane 14, a force may act upon the ground plane 14 as the side of the vehicle 10 encounters trees, debris, or other brush in the field. The distal ends of the members 20 may move independently allowing the general shape of the ground plane 14 to pivot, fold, skew, scissor, or collapse when a force acts upon the ground plane 14. When the force is removed, the ground plane 14 will return to the original shape in accordance with the embodiment of the invention.

We claim:

1. A collapsible ground plane for an antenna comprising:
- a hub for mounting to one of a riser or an antenna,
- a set of radial conductive members extending radially from a proximal end mounted to the hub to a distal end, and having connectors to electrically connect to an antenna, and
- a peripheral conductive member connected between at least two distal ends of adjacent radial conductive members,
- wherein each member of the set of radial conductive members and the peripheral conductive member has a linkage which can yield under a force then return to its original shape when the force is relieved.

2. The collapsible ground plane of claim 1 wherein the hub is conductive and the mounting of the proximal end to the hub is a connector.

3. The collapsible ground plane of claim 1 wherein the hub has a center hole to accommodate cabling from the antenna.

4. The collapsible ground plane of claim 1 comprising at least eight radial conductive members and one peripheral conductive member connected to all of the distal ends.

5. The collapsible ground plane of claim 1 wherein the linkage comprises at least one of a curved blade, a flat blade, a spring, a bendable tube, a wire, telescoping arms, rigid-foldable cellular structures, or a shape memory alloy component.

6. The collapsible ground plane of claim 5 wherein the linkage comprises two parallel curved blades spaced from each other with concave portions in facing relationship.

7. The collapsible ground plane of claim 1 further comprising a covering on one of the set of radial conductive members or the peripheral conductive member.

8. The collapsible ground plane of claim 7 wherein the covering comprises heat shrink tubing.

9. The collapsible ground plane of claim 1 wherein the peripheral conductive member is a flexible cable.

10. An antenna assembly comprising:

a satcom antenna;

a conductive hub mounted to a lower end of the satcom antenna;

a set of radial conductive members extending radially from a proximal end mounted to the conductive hub to a distal end, and a peripheral conductive member connected between at least two distal ends of adjacent radial conductive members, wherein each member of the set of radial conductive members and the peripheral conductive member has a linkage which can yield under a force then return to its original shape when the force is relieved.

11. The antenna assembly of claim 10 further comprising a riser on which the conductive hub is mounted.

* * * * *